US007874359B2

(12) United States Patent
Bissonnette et al.

(10) Patent No.: US 7,874,359 B2
(45) Date of Patent: Jan. 25, 2011

(54) METHODS OF RETRIEVING DATA FROM A PIPE CONVEYED WELL LOGGING ASSEMBLY

(75) Inventors: Harold Steven Bissonnette, Sugar Land, TX (US); Todor K Sheiretov, Houston, TX (US); Christopher S Del Campo, Houston, TX (US); Matthew McCoy, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 24 days.

(21) Appl. No.: 12/367,607

(22) Filed: Feb. 9, 2009

(65) Prior Publication Data

US 2009/0194275 A1 Aug. 6, 2009

Related U.S. Application Data

(63) Continuation-in-part of application No. 11/753,192, filed on May 24, 2007, now Pat. No. 7,661,475.

(60) Provisional application No. 60/891,775, filed on Feb. 27, 2007, provisional application No. 61/065,666, filed on Feb. 14, 2008, provisional application No. 61/065,718, filed on Feb. 14, 2008, provisional application No. 61/065,719, filed on Feb. 14, 2008.

(51) Int. Cl.
*E21B 47/00* (2006.01)

(52) U.S. Cl. ..... 166/254.2

(58) Field of Classification Search ..... 166/254.2, 166/377, 117

See application file for complete search history.

(56) References Cited

U.S. PATENT DOCUMENTS

| | | | | |
|---|---|---|---|---|
| 6,331,777 | B1 | 12/2001 | Van Den Brink et al. | |
| 6,419,013 | B1 | 7/2002 | Milne et al. | |
| 6,488,085 | B1 | 12/2002 | Milne et al. | |
| 6,557,631 | B1 | 5/2003 | Spencer et al. | |
| 6,578,631 | B2 | 6/2003 | Milne et al. | |
| 6,755,257 | B2 | 6/2004 | Spencer et al. | |
| 6,827,149 | B2 * | 12/2004 | Hache | 166/381 |
| 6,834,719 | B2 | 12/2004 | Fritchley et al. | |
| 7,201,231 | B2 | 4/2007 | Chaplin et al. | |
| 2003/0218547 | A1 * | 11/2003 | Smits et al. | 340/853.9 |
| 2004/0016542 | A1 * | 1/2004 | Hache | 166/254.2 |
| 2006/0256655 | A1 * | 11/2006 | Sinha et al. | 367/31 |
| 2007/0107939 | A1 | 5/2007 | Goldberg et al. | |
| 2008/0068209 | A1 * | 3/2008 | Sugiyama et al. | 340/853.2 |

FOREIGN PATENT DOCUMENTS

| | | |
|---|---|---|
| GB | 2388856 | 11/2003 |
| WO | 96/28636 A1 | 9/1996 |

* cited by examiner

*Primary Examiner*—William P Neuder
(74) *Attorney, Agent, or Firm*—Michael L. Flynn; David Hofman; Jody Lynn DeStefanis

(57) ABSTRACT

A method of performing a pipe conveyed well logging operation is provided that includes providing a pipe conveyed well logging assembly having a pipe string, a memory logging tool and a memory module; deploying the assembly into a wellbore; operating the memory logging tool to perform a logging operation to obtain logging data from the wellbore; and retrieving the obtained logging data prior to withdrawing the pipe string from the wellbore.

23 Claims, 9 Drawing Sheets

METHODS OF RETRIEVING DATA FROM A PIPE CONVEYED WELL LOGGING ASSEMBLY

CROSS-REFERENCE TO RELATED APPLICATION

This application claims priority under 35 U.S.C. §119(e) to U.S. Provisional Application Ser. Nos. 61/065,666; 61/065,718; and 61/065,719, each filed on Feb. 14, 2008, and each of which is incorporated herein by reference. In addition, this application is a continuation-in-part of U.S. patent application Ser. No. 11/753,192, filed on May 24, 2007 now U.S. Pat. No. 7,661,475; which in turn is entitled to the benefit of, and claims priority to U.S. Provisional Patent Application Ser. No. 60/891,775, filed on Feb. 27, 2007, the entire disclosures of each of which are incorporated herein by reference.

FIELD OF THE INVENTION

The present invention relates generally to well logging, and more particularly to pipe conveyed memory based well logging.

BACKGROUND

Logging tools are commonly used in subterranean hydrocarbon wellbores to obtain geological information related to the wellbore. Such logging tools are most often conveyed into these wellbores via a wireline cable using gravity to guide the tools into the wellbore. The wireline cable provides a means to control tool descent and position, to transfer data from a downhole position to the wellbore surface, and to retrieve the tools from the wellbore. Wellbore conditions, such as wellbore inclinations greater than approximately 60 degrees from the vertical, and/or severe washouts or ledges are commonly referred to as tough logging conditions (TLCs) and are generally not suitable for gravity tool deployment by conventional wireline cable means. Such conditions typically require other conveyance means such as a drill pipe, to reach a position in a TLC wellbore where logging is desired. Additionally, or in the alternative, a tractor may be used to assist in the conveyance.

Drill pipe conveyed logging tools often include wireless or memory based logging tools. Such tools are typically either powered by downhole batteries, and equipped with memory devices for storing collected data. Currently, these wireless tools must be retrieved to the surface of the wellbore in order to recover the collected data. Such retrieval is time consuming, often requiring 15 hours or more to complete. Thus, imposing a considerable risk to the logging operation, since it cannot be known if the log was properly performed or the data was properly collected until retrieval is complete.

In spite of the potential risks, there is an increasing desire for drill pipe conveyed logging, driven by increased horizontal well applications and the potential cost savings of logging integrated with hole conditioning runs. Accordingly, a need exists for improved pipe conveyed logging tools and/or techniques.

SUMMARY OF THE INVENTION

One embodiment of the present invention includes a pipe conveyed well logging assembly and a method of performing a wellbore logging operation using a logging tool operated in memory mode.

In another embodiment the present invention includes a mechanical means to convey and deploy a memory logging tool with pipe assisted conveyance while retaining pump through and well control functionality.

In still another embodiment the present invention includes means to remotely recover data obtained downhole by a memory logging tool.

BRIEF DESCRIPTION OF THE DRAWINGS

The exemplary embodiments of the present invention will be better understood by reference to the following detailed description when considered in conjunction with the accompanying drawings wherein.

DETAILED DESCRIPTION OF THE DRAWINGS

Figure 1:
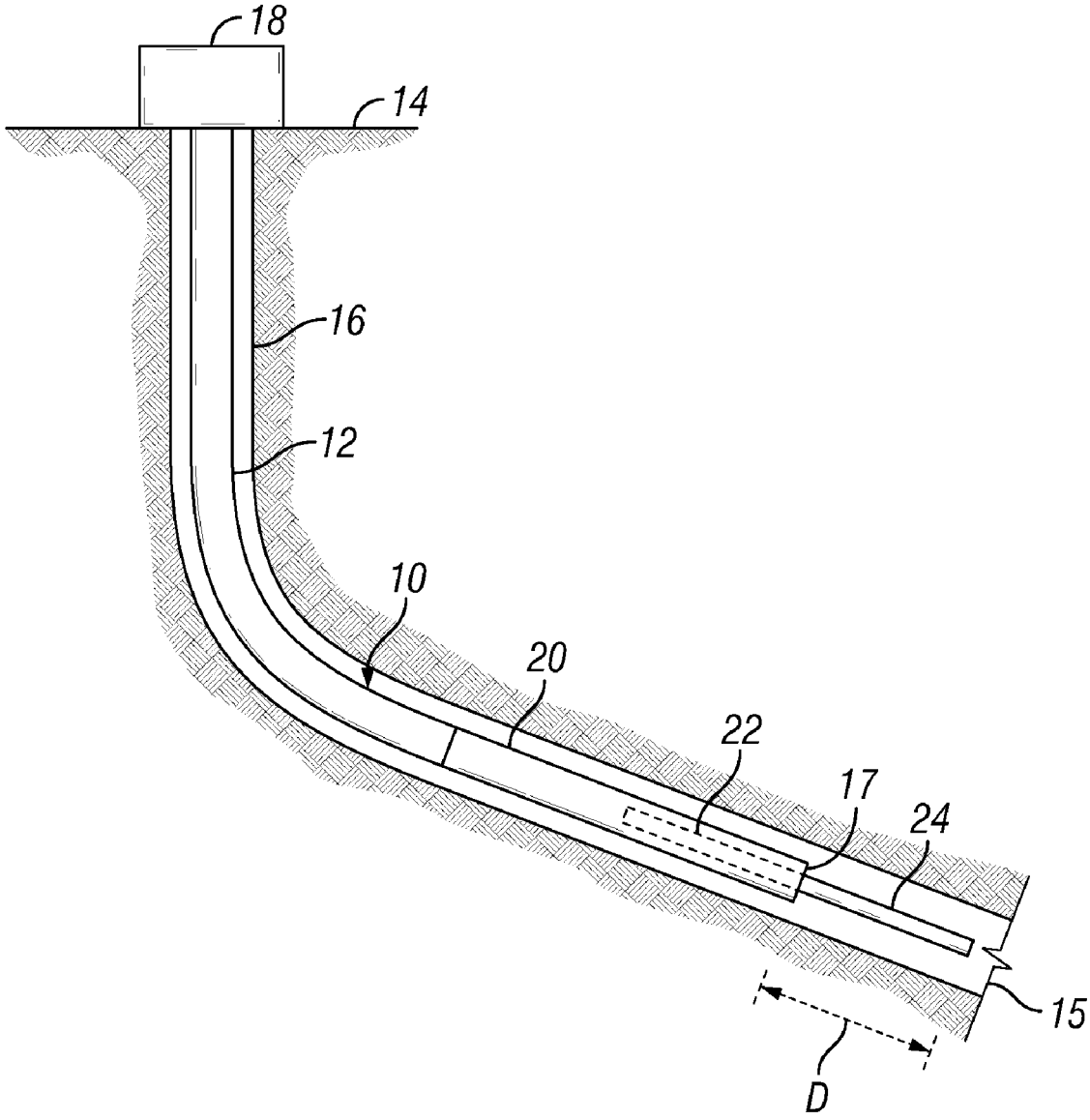
FIG. 1 is a schematic view of a pipe conveyed well logging assembly according to one embodiment of the present invention disposed in a subterranean hydrocarbon wellbore.

As shown in FIGS. 1-13, embodiments of the present invention are directed to a pipe conveyed well logging assembly 10. This assembly 10 includes a pipe string 12, such as coiled tubing or drill pipe, connected to a carrier assembly 20 which carries a memory logging tool 24. The pipe string 12 may be driven from the surface 14 of a subterranean hydrocarbon wellbore 16 by appropriate surface equipment 18 to a position within a wellbore 16 where logging is desired. This driving of the pipe string 12 allows the assembly 10 to be used in wellbores having tough logging conditions (TLCs).

However, the driving forces necessary to convey the assembly 10 can easily crush the memory logging tool 24, which is relatively delicate to outside forces. As such, as the assembly 10 is forcibly driven to an area where logging is desired, the memory logging tool 24 is protected within the walls of the carrier assembly 20. This protected position of the memory logging tool 24 disposed within the carrier assembly 20 is referred to herein as the retracted position (see for example FIG. 5).

As described below, when an area desired to be logged is reached, the memory logging tool 24 may be ejected from the carrier assembly 20, such that the memory logging tool 24 protrudes from a bottom end of the carrier assembly 20. This ejected position of the memory logging tool 24 is referred to herein as the extended position (see for example FIG. 9). In the extended position, the memory logging tool 24 may begin its memory logging.

Figure 2:
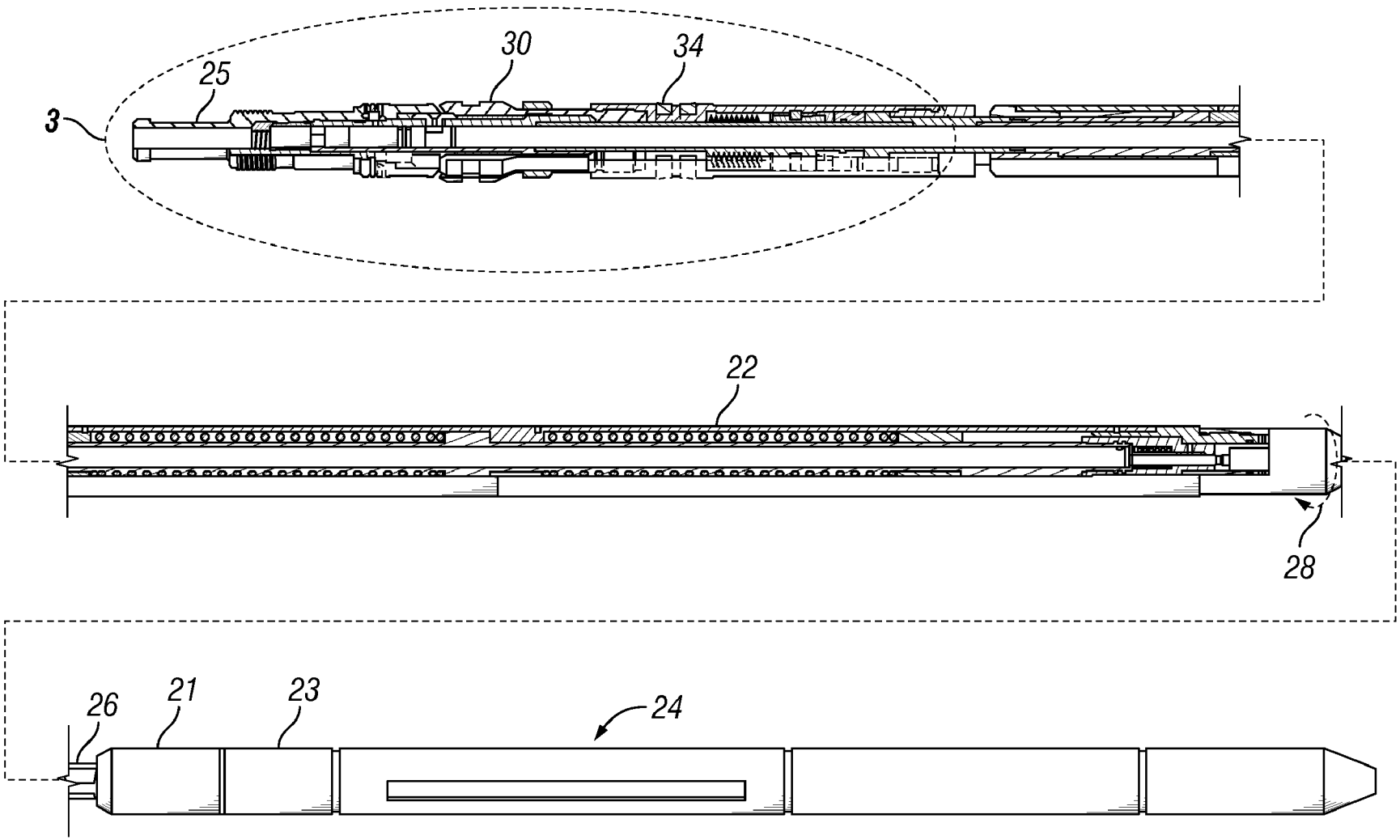
FIG. 2 is a memory logging tool, which forms a portion of the pipe conveyed well logging assembly of FIG. 1, showing the memory logging tool removed from the remainder of the assembly for clarity.

To highlight some of the internal features of the pipe conveyed well logging assembly 10, FIG. 2 shows the memory logging tool 24 separated from the carrier assembly 20. As shown, the memory logging tool 24 is connected to a deployment head 22. In one embodiment, a rotatable mounting device, such as a low torque swivel 26 is used to connect the memory logging tool 24 to the deployment head 22. With this connection, the deployment head 22 is allowed to rotate about a longitudinal axis with respect to the memory logging tool 24 as shown by arrow 28. Thus, in situations where the deployment head 22, the carrier assembly 20, and the pipe string 12 rotate together, the memory logging tool 24 maintains the ability to remain stationary. That is, the swivel 26 allows the pipe string 12 and the carrier assembly 20 to be rotated without a torque being transferred to the memory logging tool 24.

Figure 3:
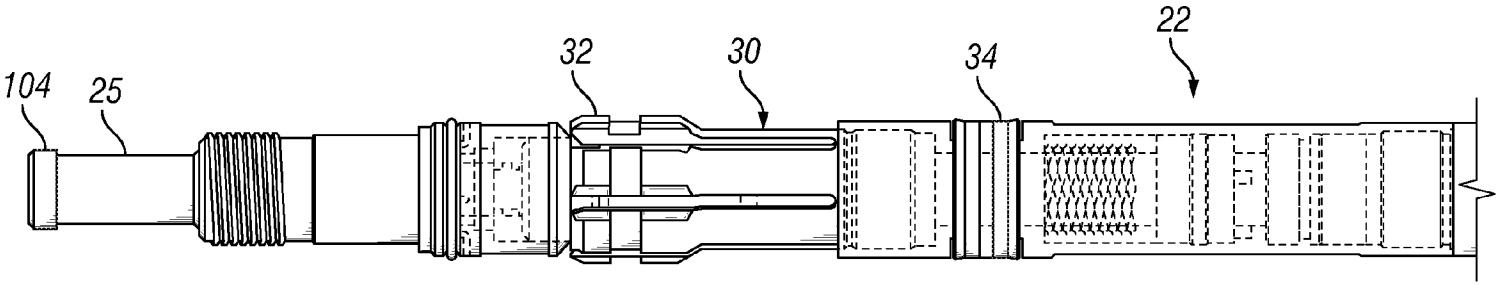
FIG. 3 is an enlargement of a portion of FIG. 2 taken from detail 3 of FIG. 2.

Also shown in FIG. 2, and in the enlargement of FIG. 3, and as described further below, the deployment head 22 includes a collet 30 having radially movable latch fingers 32. These latch fingers 32 interact with portions of the carrier assembly 20 to securely latch the memory logging tool 24 in either the above described retracted position or the above described extended position. Also shown in FIGS. 2-3, and described further below, are seals 34 which extend from an outer surface of the deployment head 22. In addition, in one embodiment a fishing neck 25 is attached to an upper end of the deployment head 22, the significance of which is described below.

As is also shown in FIG. 2, the memory logging tool 24 includes a battery 21. The battery 21 is operable to activate and power the memory logging tool 24 during a logging operation. The memory logging tool 24 may also include a memory module 23, which collects and stores logging data obtained by the memory logging tool 24 during a logging operation. Methods for retrieving logging data collected by the memory module are described below.

Figure 4:
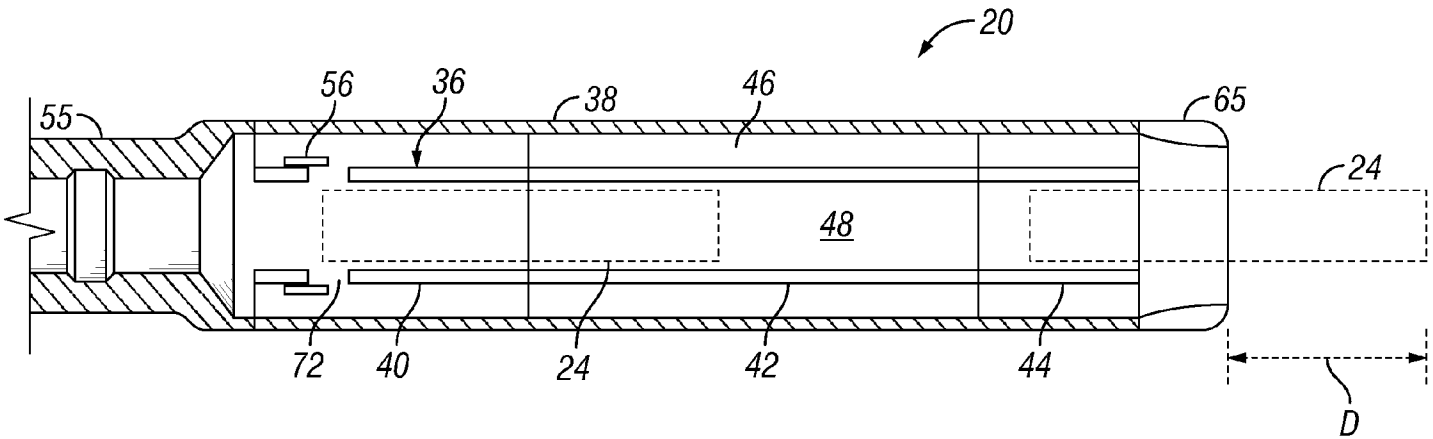
FIG. 4 is a schematic view of a carrier assembly, which forms a portion of the pipe conveyed well logging assembly of FIG. 1.

FIG. 4 shows a simplified schematic version of the carrier assembly 20. As shown, the carrier assembly 20 includes an inner housing 36 and an outer housing 38. In one embodiment, the inner and outer housings 36, 38 are each substantially cylindrical tubular structures which may be concentrically positioned. In one embodiment, an upper portion of the outer housing 38 includes a pipe adapter 55 for connection to the pipe string 12; and a lower portion of the outer housing 38 includes a guide shoe 65. The guide shoe 65 may include an exterior fluted reamer profile. In one embodiment, the pipe adapter 55 includes an internal profile to accept a pump-down check valve, which may be preinstalled as a redundant blowout prevention valve. Note that the leftmost dashed representation of the memory logging tool 24 in FIG. 4 indicates the retracted position of the memory logging tool 24, and the rightmost dashed representation of the memory logging tool 24 in FIG. 4 indicates the extended position of the memory logging tool 24.

As described in detail below, the inner housing 36 includes an ejector assembly 40, a receiver assembly 44 and a transition area 42 disposed therebetween. Mentioned briefly here and in detail below, the ejector assembly 40 includes an upper latch for holding the memory logging tool 24 in the retracted position, and the receiver assembly 44 includes a lower latch for holding the memory logging tool 24 in the extracted position.

The ejector assembly 40 also includes a valve assembly (described in detail below in conjunction with FIGS. 6A-8) for selectively directing a fluid flow either through an inner bore 48 of the inner housing 36, or to an annulus 46 between the inner and outer housings 36, 38. Such upper and lower latches, and such alternate flowpaths would not be possible if the carrier assembly 20 were a simple drill pipe.

Figure 5:
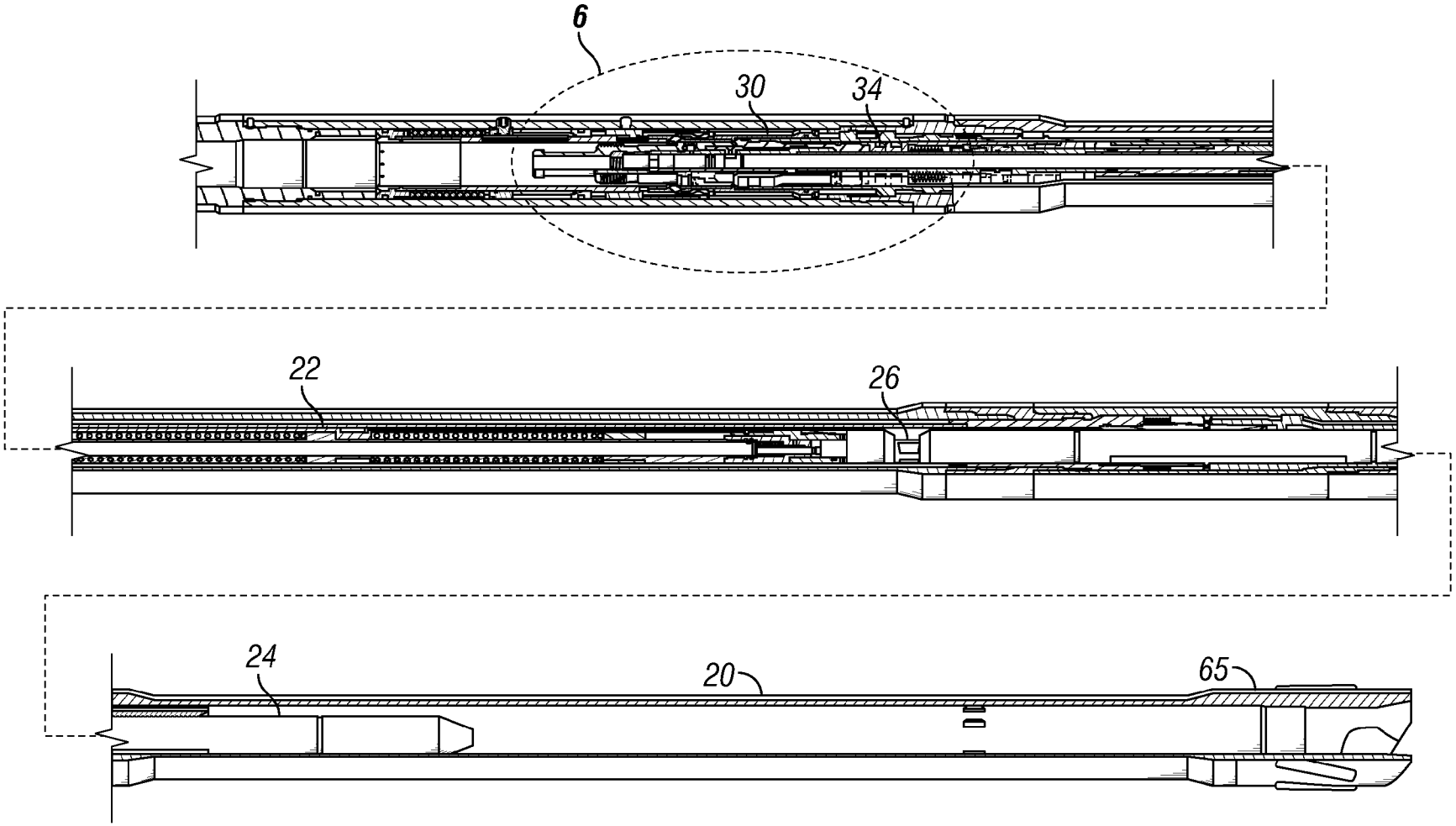
FIG. 5 shows the memory logging tool of FIG. 2 retracted within a carrier assembly, which forms a portion of the pipe conveyed well logging assembly of FIG. 1.
Figure 6A:
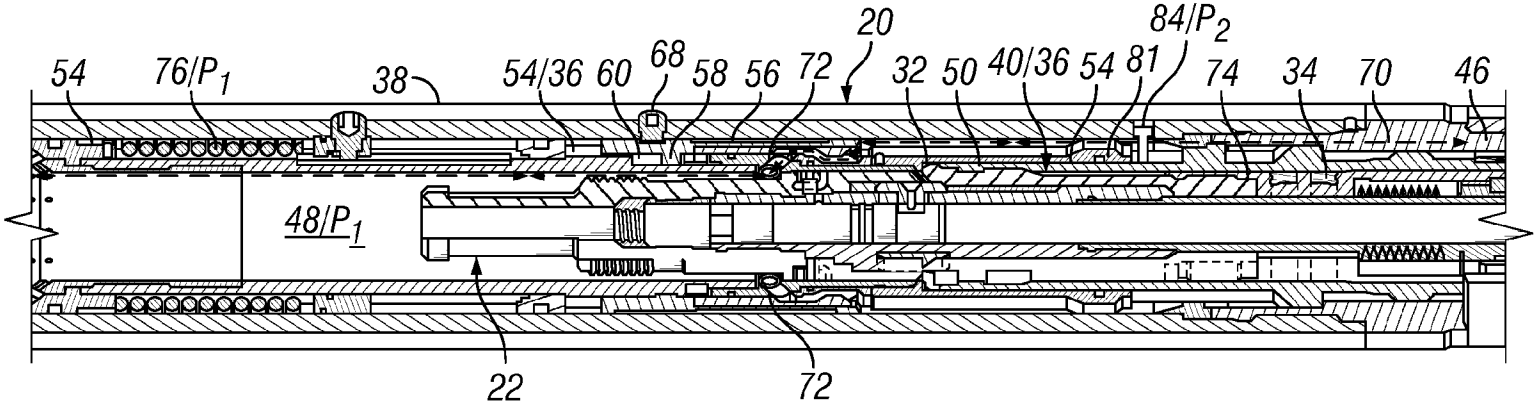
FIGS. 6A-6B each show an enlargement of a portion of FIG. 5 taken from detail 6 of FIG. 5, with FIG. 6A showing a valve assembly in an open position and FIG. 6B showing the valve assembly in a closed position.
Figure 6B:
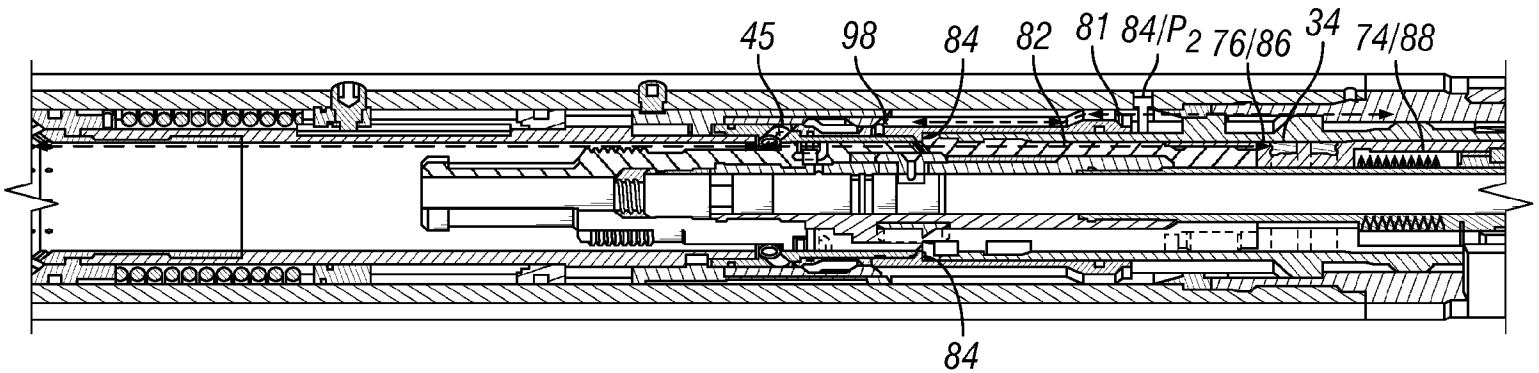

FIG. 5 shows the memory logging tool 24 in the retracted position. FIGS. 6A-6B show an enlargement of a portion of FIG. 5. As shown in FIGS. 6A-6B, the ejector assembly 40 forms a portion of the inner housing 36 of the carrier assembly 20. An inner surface of the ejector assembly 40 includes a profile (described herein as the upper latch profile 50) which matches an outer profile of the latch fingers 32 of the deployment head 22. As such, when the latch fingers 32 of the deployment head 22 are mated with the upper latch profile 50 of the carrier assembly 20, the memory logging tool 24 is securely latched in the retracted position.

Figure 9:
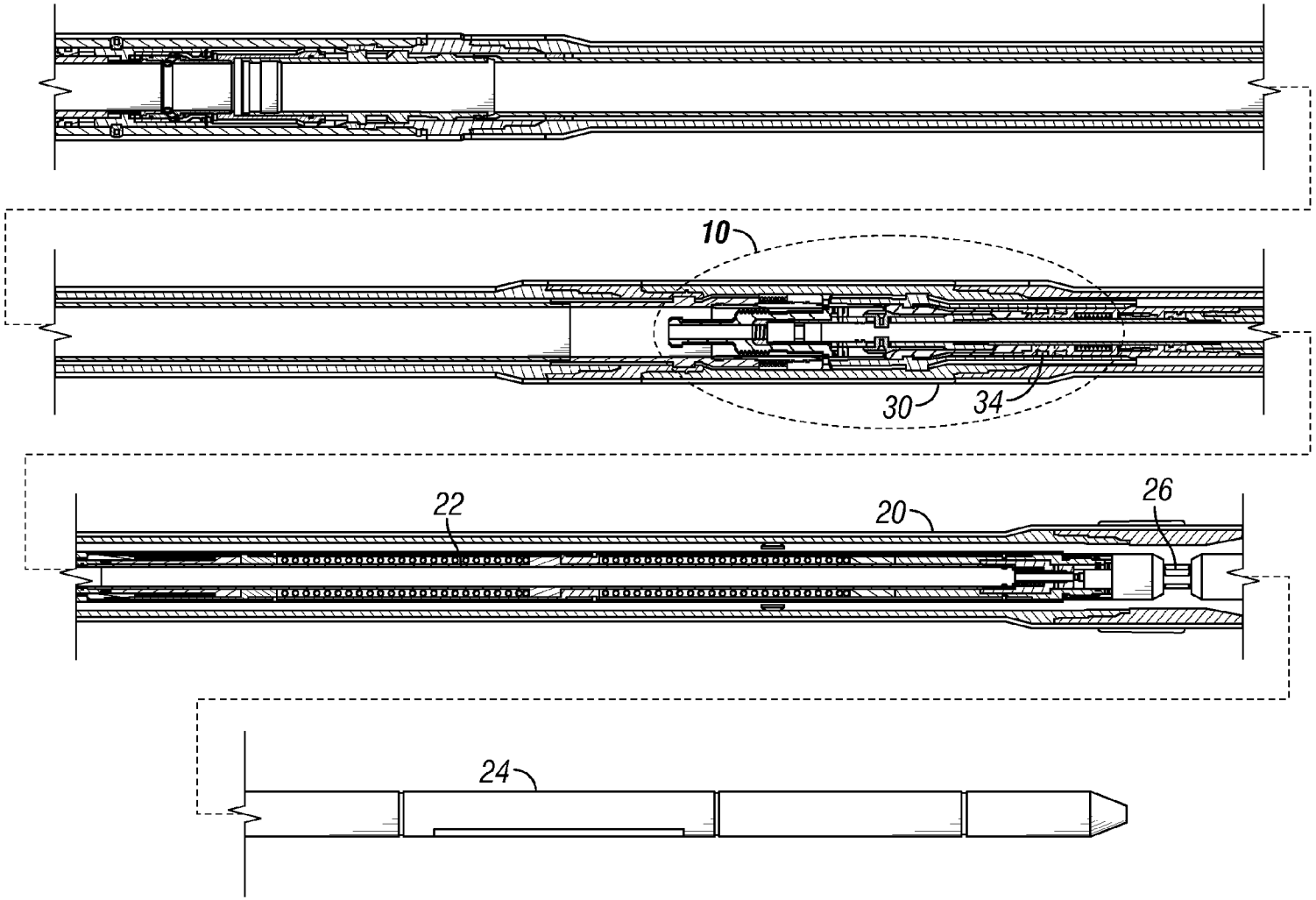
FIG. 9 shows the memory logging tool of FIG. 2 protruding from a carrier assembly, which forms a portion of the pipe conveyed well logging assembly of FIG. 1.
Figure 10:
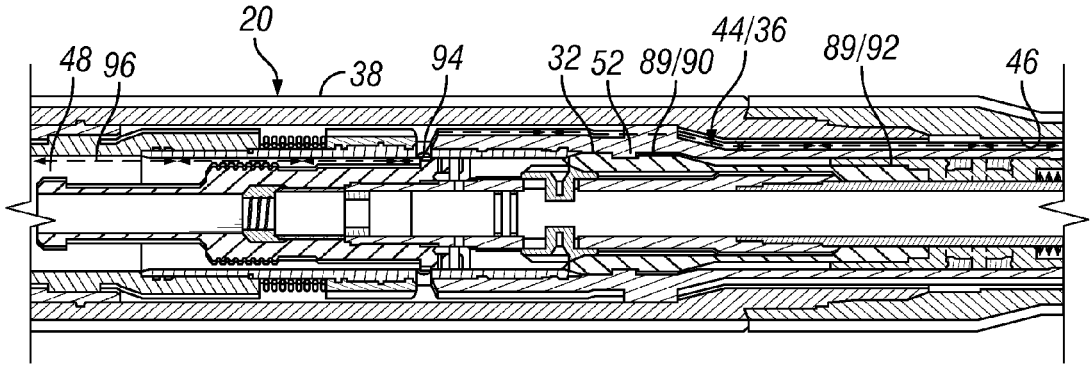
FIG. 10 is an enlargement of a portion of FIG. 9 taken from detail 10 of FIG. 9.
Figure 11:
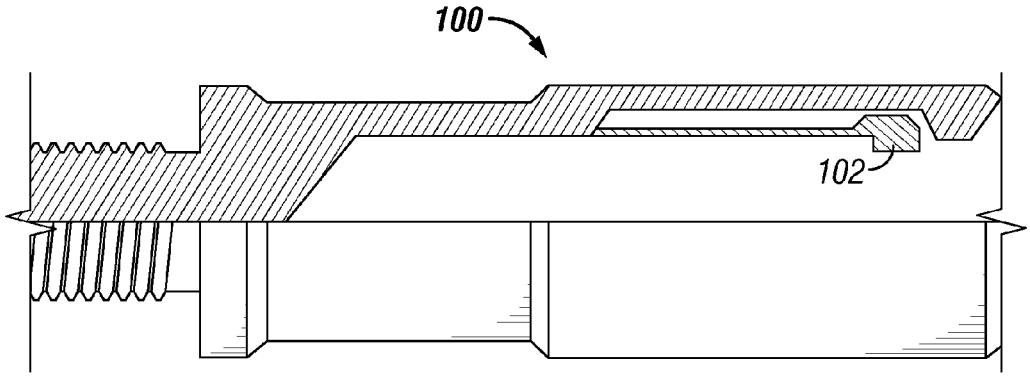
FIG. 11 shows a fishing tool for remotely retrieving logging data from the pipe conveyed well logging assembly.

FIG. 9 shows the memory logging tool 24 in the extended position. FIG. 10 shows an enlargement of a portion of FIG. 9. As shown in FIG. 10, the receiver assembly 44 forms a portion of the inner housing 36 of the carrier assembly 20. An inner surface of the receiver assembly 44 includes a profile (described herein as the lower latch profile 52) which matches an outer profile of the latch fingers 32 of the deployment head 22. As such, when the latch fingers 32 of the deployment head 22 are mated with the lower latch profile 52 of the carrier assembly 20, the memory logging tool 24 is securely latched in the extended position.

FIGS. 6A-8 show how the memory logging tool 24 is moved from the retracted position to the extended position according to one embodiment of the present invention. As shown in FIG. 6A, a piston 54 forms an upper portion of the ejector assembly 40. Rotatably mounted about an outer surface of the piston 54 is a valve assembly 56. However, the valve assembly 56 also includes an inwardly extending lug 58 which rides within a circumferentially extending groove 60 in the outer surface 62 of the piston 54, such that the valve assembly 56 is longitudinally movable by the piston 54 (see also FIGS. 6C and 8).

Figure 6C:
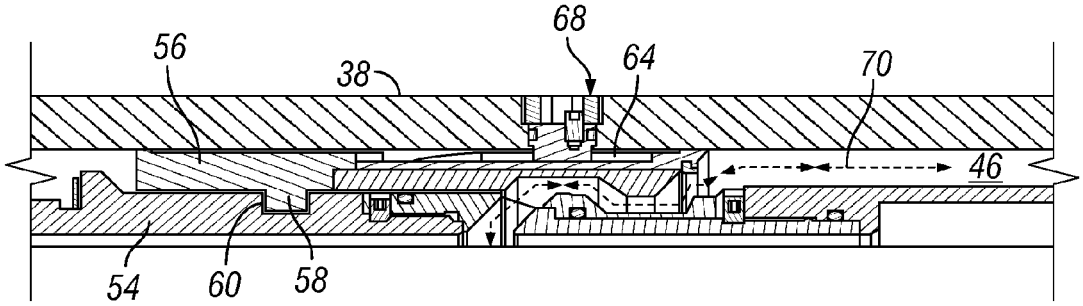
FIG. 6C is an enlargement of the valve assembly of FIG. 6A, showing the valve assembly in the open position.
Figure 7:
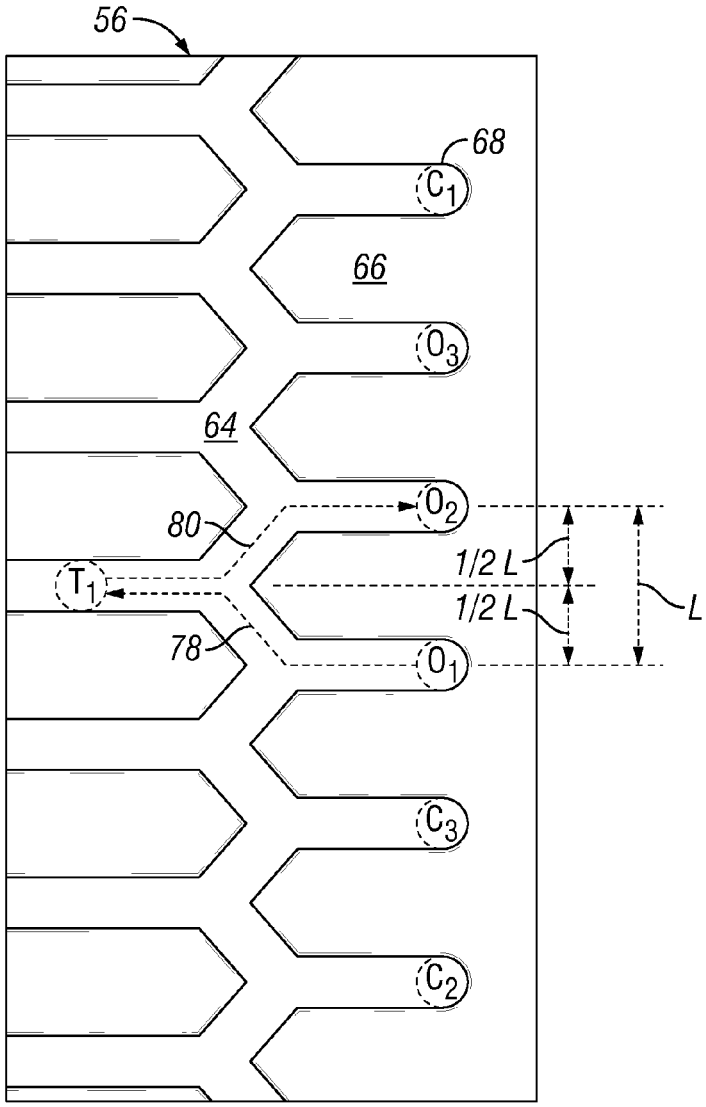
FIG. 7 is a top view of an outer surface of the valve assembly of FIGS. 6A-6C.

As is further shown in FIG. 6A, an outer surface 66 of the valve assembly 56 includes a circumferentially extending "J-slot" groove 64 (see also FIGS. 6C and 7). A stationary pin 68, such as a set screw extending radially inwardly from the outer housing 38 of the carrier assembly 20, rides within the J-slot groove 64. Thus, as discussed in detail below, longitudinal movements of the piston 54 in combination with the outer housing pin 68 riding in the valve J-slot 64, and the valve lug 58 riding in the piston groove 60, cause the valve assembly 56 to move both rotationally and longitudinally with respect to piston 54. These movements cause the valve assembly 56 to shift between an open position (FIG. 6A) and a closed position (FIG. 6B) as described further below.

As the pipe conveyed well logging assembly 10 is conveyed further and further downhole into the wellbore 16, a wellbore hydrostatic pressure external to the pipe conveyed well logging assembly 10 gradually increases, thus creating a large pressure differential between the internal environment of the assembly 10 and the external environment of the assembly 10. If this pressure differential is too large, then internal components within the assembly 10 can be undesirably displaced and/or damaged, and at extreme pressure differentials, the assembly 10 itself can even collapse or implode.

Thus, an internal pressure may be created within the assembly 10 to prevent too large of a pressure differential from developing between the internal and external environments of the assembly 10. This internal pressure may be created by pumping a circulation fluid through the assembly 10. The surface equipment 18 described above may include a pump for providing this circulating fluid to the assembly 10.

As such, as the pipe conveyed well logging assembly 10 is conveyed downhole to a position where logging is desired, the valve assembly 56 is typically held in the open or run-in-hole position of FIG. 6A to allow a circulating fluid to be pumped therethrough. Note that in the open position of the valve assembly 56, orifices 72 in the piston 54 fluidly connect the inner bore 48 of the inner housing 36 to the annulus 46 between the inner and outer housings 36, 38 of the carrier assembly 20. Thus, with the valve assembly 56 in the open position, a circulation fluid is allowed to follow a flow path shown by arrows 70. As shown in FIG. 6A, as the circulating fluid is pumped through the assembly 10, the fluid is directed through the piston orifices 72 rather than continuing down the inner bore 48 of the inner housing 36. This is due to a fluid seal that is created between an inner surface 74 of the ejector assembly 40 and outer seals 34 on the deployment head 22.

Thus, when the memory logging tool 24 is in the retracted position, protected within the inner housing 36 of the carrier assembly 20, and the valve assembly 56 is in the open position, circulating fluid is not allowed to enter the inner bore 48 of the inner housing 36 (where the memory logging tool 24 is disposed) and instead is allowed to circulate through the assembly 10 in the annulus 46 between the inner and outer housings 36, 38. Thus, as the circulating fluid is circulated through the assembly 10, it is not allowed to contact the memory logging tool 24. Consequently, any debris clogging or erosive effects that the circulating fluid might have on the memory logging tool 24 is avoided.

Also, note that when the valve assembly 56 is in the open position, circulation fluid is allowed to flow along flow path 70 in both the downhole and uphole directions. That is, both a regular circulation and a reverse circulation of the circulating fluid is allowed when the valve assembly 56 is in the open position.

Referring back to the interactions of the piston 54 with the valve assembly 56 (as shown in FIGS. 6A-8), the piston 54 is spring biased in the uphole direction by a compression member 76 such as a spring. When a pressure differential between the inner bore 48 of the inner housing 36 and the annulus 46 between the inner and outer housings 36, 38 is small, then the spring 76 is uncompressed and the piston 54 is stationary. However, exceeding a predetermined pressure differential threshold $P_1$ between the inner bore 48 and the annulus 46 causes the spring 76 to compress, allowing the piston 54 to move longitudinally downwardly relative to the deployment head 22.

This pressure differential threshold $P_1$ may be exceeded by operating a pump in the surface equipment 18 to either increase the flow rate of the circulating fluid when the valve assembly 56 is open, or to simply increase the pressure of the circulating fluid when the valve assembly 56 is closed and the circulating fluid is stationary. In a similar manner, the pump in the surface equipment 18 may be used to create other pressure differentials described below for effectuating other actions within the assembly 10.

In one embodiment, the valve assembly 56 is moved between the open and closed positions as shown in FIGS. 6A-8. In this embodiment, the valve assembly 56 includes three open positions $O_1$-$O_3$ and three closed positions $C_1$-$C_3$. However, as described below, in alternative embodiments the valve assembly 56 may include as few as one open position and one closed position.

Starting with the open position $O_1$, movement of the valve assembly 56 is now described. That is, at position $O_1$, the valve assembly 56 is open; the outer housing pin 68 is in position $O_1$ within the J-slot groove 64 in the outer surface 66 of the valve assembly 56; and the valve lug 58 is in position $O_1$ within the circumferential groove 60 in the outer surface 62 of the piston 54. By exceeding the pressure differential threshold $P_1$, the piston 54 is moved longitudinally downward relative to the deployment head 22 as described above. The downward movement of the piston 54 causes the valve assembly 56 to move downwardly due to the valve lug 58 being held within the piston groove 60. The downward movement of the valve assembly 56 causes the outer housing pin 68 to follow a path as indicated by arrow 78 from position $O_1$ to position $T_1$. Note however, that although the J-slot groove 64 allows for a further longitudinally downward movement of the piston 54 than that of the position of $T_1$, the downward movement of the piston 54 is limited by a shear pin 84 extending radially inwardly from the outer housing 38, the significance of which is described below.

Since the valve assembly 56 is free to rotate with respect to the piston 54, the outer housing pin 68 moving from position $O_1$ to position $T_1$ causes the valve assembly 56 to rotate, creating a relative lateral movement (1/2L) between the valve assembly 56 and the piston 54. The outer housing pin 68 will then stay in position $T_1$ until the predetermined pressure differential threshold $P_1$ between the inner bore 48 and the annulus 46 is no longer exceed. At that point, the spring 76 decompresses, forcing the piston 54 to move longitudinally upward, which in turn causes the outer housing pin 68 to follow a path as indicated by arrow 80 from position $T_1$ to position $O_2$. As the outer housing pin 68 moves from position $T_1$ to position $O_2$, the valve assembly 56 rotates, creating another relative lateral movement (1/2L) between the valve assembly 56 and the piston 54. Thus, during one "cycle" of the valve assembly 56, (such as the cycle from position $O_1$ to position $O_2$) the valve assembly 56 moves by a lateral distance of L.

Figure 8:
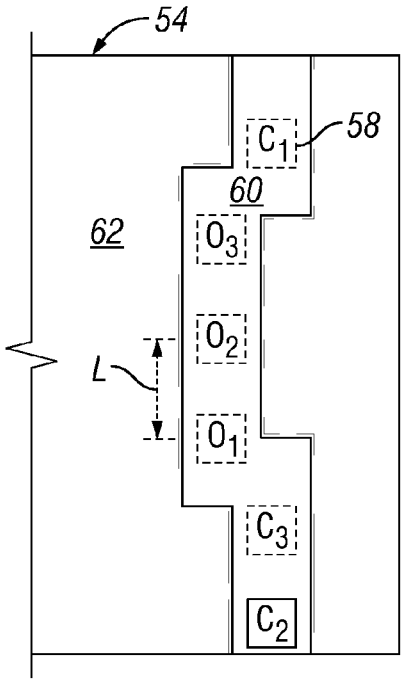
FIG. 8 is a top view of an outer surface of a piston which interacts with the valve assembly of FIGS. 6A-6C.

Each time the valve assembly 56 moves laterally, the valve lug 58 correspondingly moves laterally within the piston groove 60, such that during one full "cycle" movement of the valve assembly 56, the valve lug 58 moves by a lateral distance of L relative to the piston 54. By alternately exceeding and falling below the predetermined pressure differential threshold $P_1$ between the inner bore 48 and the annulus 46, the valve assembly 56 may be cycled to each of the valve positions $O_1$ to $O_3$ and $C_1$ to $C_3$ as shown in FIGS. 7-8.

For example, when the valve assembly 56 is cycled from position $O_2$ to $O_3$, the valve assembly 56 rotates relative to the piston 54, causing the valve lug 58 to laterally move by a distance of L relative to the piston 54 just as it does in moving from position $O_1$ to $O_2$. Similarly, when the valve assembly 56 is cycled from position $O_3$ to $C_1$, the valve assembly 56 rotates relative to the piston 54, causing the valve lug 58 to laterally move by a distance of L relative to the piston 54 just as it does in the previous two described cycles. However, due to the shape of the piston groove 60, when the valve assembly 56 is cycled from position $O_3$ to $C_1$, and the valve lug 58 is laterally moved by the distance L relative to the piston 54, the valve assembly 56 moves longitudinally forward relative to the piston 54. This relative longitudinal movement causes the valve assembly 56 to occlude or close off the orifices 72 in the piston 54 (as shown by the X labeled 45 in FIG. 6B). As a result, the flow path 70 between the inner bore 48 and the annulus 46 is closed off, and the valve assembly 56 is said to be in the closed position.

In the closed position of the valve assembly 56, the circulating fluid is blocked from entering the annulus 46 between the inner and outer housings 36, 38, and instead is directed to another flow path 82. Following this flow path 82, the motion of the circulating fluid is stopped by the fluid seals 34 disposed on the outer surface of the deployment head 22, which create a fluid tight seal between the deployment head 22 an the inner surface 74 of the ejector assembly 40.

With the valve assembly 56 in the closed position $C_1$, the shear pin 84 (introduced above) may be sheared by cycling the valve assembly 56 from position $C_1$ to $C_2$. That is, the shear pin 84 is sheared by an end 81 of the piston 54 when a predetermined pressure differential threshold $P_2$ between the inner bore 48 and the annulus 46 is exceeded causing the piston 54 to compress the piston spring 78 and move longitudinally downwardly with a force sufficient to shear shear pin 84 (note, that the pressure differential threshold $P_2$ required to shear the shear pin 84 is greater than the pressure differential threshold $P_1$ required to compress the piston spring 78).

With the shear pin 84 sheared by the cycling of the valve assembly 56 from position $C_1$ to $C_2$, the full longitudinal movement of the piston 54 is no longer blocked; and when the valve assembly 56 is cycled from position $C_2$ to $C_3$, the extra longitudinal movement of the piston 54 allows a shoulder 86 on a downhole portion of the piston 54 to contact and radially inwardly compress the latch fingers 32 on the collet 30 of the deployment head 22. This radially inward compression of the latch fingers 32 disengages the latch fingers 32 from the upper latch profile 50 of the carrier assembly 20.

With the latch fingers 32 disengaged, frictional drag from the circulating fluid flowing through inner bore 48 past the deployment head 22 carries the deployment head 22 (and hence the memory logging tool 24) downwardly relative to the carrier assembly 20. This downward movement continues until the latch fingers 32 of the deployment head 22 reach and engage the lower latch profile 52 in the lower portion or receiver assembly 44 of the carrier assembly 20 as shown in FIG. 10.

In an alternative embodiment, the memory logging tool 24 may be released from the latched retracted position by an electronic trigger, such as any of the embodiments of the electronic trigger described in U.S. Pat. No. 7,337,850, filed on Mar. 4, 2008, the entire disclosures of which is incorporated herein by reference.

Note, that when the memory logging tool 24 is in the retracted position, the seals 34 of the deployment head 22 contact a small diameter portion 86 of the inner surface 74 of the ejector assembly 40. Just as the deployment head 22 begins to move downwardly in its movement from the retracted position to the extended position, the inner surface 74 of the ejector assembly 40 opens up to a larger diameter 88 such that the seals 34 no longer contact the inner surface 74 of the ejector assembly 40. Similarly, in the transition area 42 of the inner housing 36 of the carrier assembly 20 (i.e., the portion of the inner housing 36 between the ejector assembly 40 and the receiver assembly 44), the seals 34 do not contact the inner surface of the transition area 42. Also similar to the ejector assembly 40, the inner surface 89 of the receiver assembly 44 includes an enlarged diameter 90 which does not contact the seals 34 and a smaller diameter 92 which engages the seals 34 just as the latch fingers 32 engage the lower latch profile 52.

Consequently, as the memory logging tool 24 is moved from the retracted position to the extended position, the seals 34 become quickly disengaged from the ejector assembly 40 upon a de-latching of the latch fingers 32 from the upper latch profile 50; remain disengaged as the deployment head 22 transverses the transition area 42; and become engaged with the smaller diameter 92 of the receiver assembly 44 upon the latching of the latch fingers 32 with the lower latch profile 52. Thus, the amount of dynamic friction that the seals 34 experience in moving from the retracted position to the extended position, and the wear and tear on the seals 34 which results from such dynamic frictional forces, is minimized.

As shown in FIG. 10, orifices 94 in the receiver assembly 44 fluidly connect the inner bore 48 of the receiver assembly 44 to the annulus 46. Thus, with the memory logging tool 24 latched in the extended position, the circulating fluid may be circulated through the assembly 10 by flowing flow path 96 through the inner bore 48 to the annulus 46 and out a lower end of the assembly 10.

Note that with the memory logging tool 24 latched in the extended position (as shown in FIG. 10), the valve assembly 56 may remain in the closed position or it may be cycled from position $C_3$ to $O_1$ to open the valve assembly 56. In the closed position reverse circulation is allowed only up to the valve assembly 56, as the valve assembly 10 prevents further reverse circulation as shown by the X labeled 98 in FIG. 6B. Thus, if reverse circulation through the entire assembly 10 is desired, then the valve assembly 56 may be cycled from position $C_3$ to $O_1$ to open the valve assembly 56. With the valve assembly 56 open, a reverse circulation of circulating fluid is allowed to follow flow path 70 through the assembly 10 as shown by FIG. 6A.

However, regardless of whether the valve assembly 56 is in the open position or the closed position, reverse circulation of a circulation fluid through the assembly 10 cannot disengage latch fingers 32 from the lower latch profile 52. That is, when the memory logging tool 24 is in the extended position, a reverse circulation of a circulation fluid through the assembly 10 cannot retract the memory logging tool 24 back into the carrier assembly 20.

Notwithstanding this, the latch fingers 32 and the lower latch profile 52 are designed such that a predetermined compressive force acting on the memory logging tool 24 will cause the latch fingers 32 to disengage from the lower latch profile 52 and allow the memory logging tool 24 to retreat at least partially back into the carrier assembly 20. The value of the compressive force on the memory logging tool 24 required to disengage the latch fingers 32 from the lower latch profile 52 is pre-calculated and defined as a compressive force that would otherwise damage the memory logging tool 24 if the latch fingers 32 were to stay engaged with the lower latch profile 52 during the actuation of the compressive force on the memory logging tool 24. Thus, concerns of damaging the memory logging tool 24 by unexpected compressive forces acting on the memory logging tool 24 when it is in the extended position are minimized.

As described above, in one embodiment the valve assembly 56 includes three open positions $O_1$-$O_3$ and three closed positions $C_1$-$C_3$. In alternate embodiments, the valve assembly 56 may include as few as one open position and one closed position, or any combination of various numbers of open positions and closed positions. In embodiments were the valve assembly 56 includes multiple open positions, however, operators of the assembly 10 are allowed to adjust flow rates of circulating fluid through the assembly 10 without risk of inadvertently closing the valve assembly 56.

For example, if the valve assembly 56 is in the above described position $O_1$, an inadvertently large (or even intentionally large) increase in flow rate through the assembly 10 will not close the valve assembly 56, but instead move it from position $O_1$ to $O_2$. The same is true when the valve assembly 56 is in position $O_2$. That is, when the valve assembly 56 is in the position $O_2$, an inadvertently large (or even intentionally large) increase in flow rate through the assembly 10 will not close the valve assembly 56, but instead move it from position $O_2$ to $O_3$.

Referring back to FIG. 1, when the assembly 10 has been deployed to a area within the wellbore 16 where logging is desired, the assembly 10 is pulled upwardly toward the surface 14 of the wellbore 16 (or in some other manner positioned) such that at least a distance D exists between a lower end 15 of the wellbore 16 and a lower end 17 of the carrier assembly 20, the distance D being equal in length to the amount of the memory logging tool 24 which protrudes from the lower end 17 of the carrier assembly 20 when the memory logging tool 24 is in the extended position.

With the distance D between the lower end 15 of the wellbore 16 and the lower end 17 of the carrier assembly 20 achieved, the memory logging tool 24 may be moved from the retracted position to the extended position, and the memory logging tool 24 may be activated to begin logging the wellbore 16. In one embodiment, the memory logging tool 24 includes a battery 21 for activating the logging. As the wellbore 16 is logged, the assembly 10 may be simultaneously pulled toward the surface 14 of the wellbore 16. This simultaneous pulling and logging may be continued until a desired length of the wellbore 16 has been logged.

After the wellbore 16 has been logged by the pipe conveyed well logging assembly 10, logging data obtained during the logging operation may be retrieved in any one of several methods. For example, the entire pipe conveyed well logging assembly 10 may be withdrawn from the wellbore 16. However, this is a time consuming process, and in some instances may be undesirable. One alternative is to withdraw the deployment head 22 and the memory logging tool 24 from the wellbore 16 without withdrawing the pipe string 12 and the carrier assembly 20. This can be accomplished by attaching a fishing tool 100, such as that shown in FIG. 11, to the fishing neck 25 of the deployment head 22. That is, as the fishing tool 100 is lowered over the fishing neck 25 of the deployment head 22, inwardly biased arms 102 latch onto a shoulder 104 of the fishing neck 25 to secure the fishing tool 100 to the fishing neck 25. Thus secured, the fishing tool 100 and the fishing neck 25 (and therefore the deployment head 22 and the memory logging tool 24) may be withdrawn from the wellbore 16 separately from the pipe string 12 and the carrier assembly 20.

Figure 12:
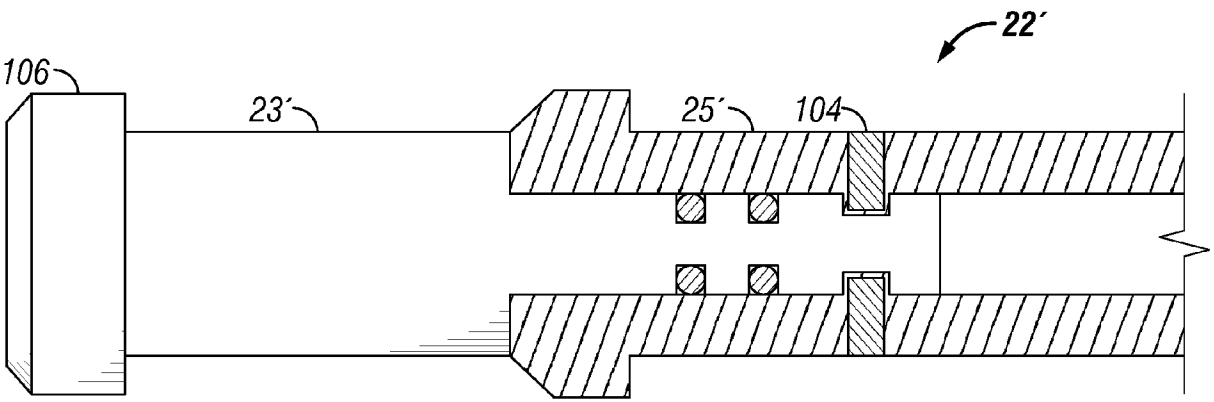
FIG. 12 shows a memory logging tool according to an alternative embodiment of the invention.
Figure 13:
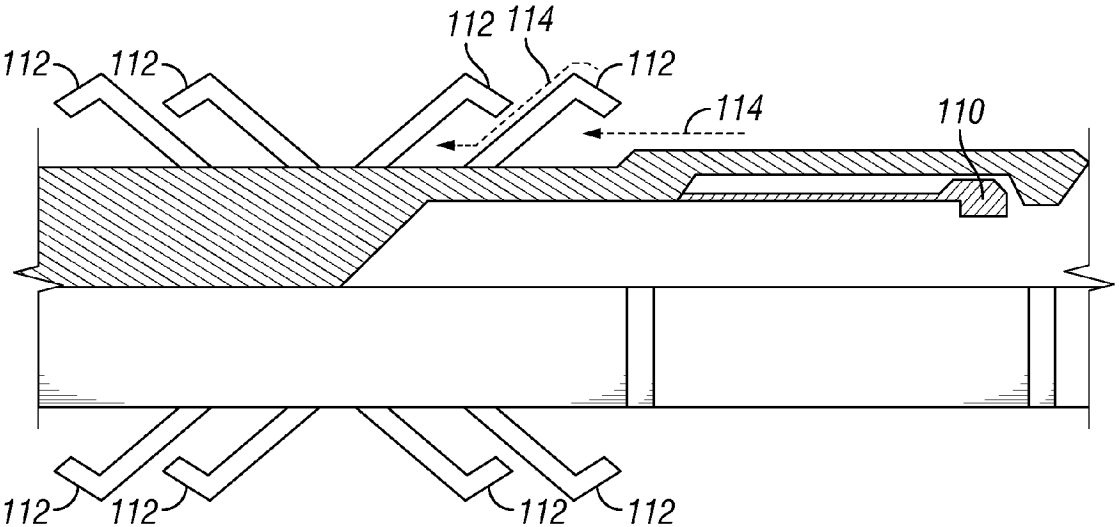
FIG. 13 shows a pumpable dart for remotely retrieving logging data from the pipe conveyed well logging assembly.

In another alternative the memory module, may be fished separately from the remainder of the pipe conveyed well logging assembly 10. An exemplary embodiment for achieving this is shown in FIG. 12. FIG. 12 is substantially the same as the embodiment of FIG. 2. However, in the embodiment of FIG. 12 the memory module 23' has been moved to an upper end of the deployment head 22'. That is, the memory module 23' is removeably connected to the fishing neck 25' of the deployment head 22', such as by one or more shear pins 104. In addition, an outer surface of the memory module 23' includes a typical fishing neck profile, with an upper shoulder 106. Thus, the fishing tool 100 may be lowered over the shoulder 106 of the memory module 23' to latch the fishing tool arms 102 to the memory module shoulder 106. Thus latched, the fishing tool 100 may be pulled by a force sufficient to shear the shear pins 104 of the memory module 23', allowing the fishing tool 100 and the memory module 23' to be withdrawn from the wellbore 16 separately from the remainder of the assembly 10.

In each of the retrieval operations described above involving the fishing tool 100, although a specific fishing tool 100 is illustrated and described, any appropriate fishing tool 100 may be used. In addition, although the fishing tool 100 may be conveyed into and withdrawn from the wellbore 16 by any appropriate method, in one embodiment the fishing tool 100 is attached to a cable, such as a slickline or a wireline cable, for effectuating the deployment and withdrawal of the fishing tool 100 from the wellbore 16.

In another alterative, a plug 108 (such as that shown in FIG. 13) may be pumped down the wellbore 16 and lowered over the memory module 23' of FIG. 12 and secured thereto by latching arms 110 of the plug 108 to the memory module shoulder 106 in a similar manner to that described above with respect to the connection of the fishing tool 100 to the memory module 23'. However, when the plug 108 is connected to the memory module 23', fins 112 form fluid tight seals with an inner surface of the inner housing 36 of the carrier assembly 20. Thus, with the plug 108 secured to the memory module 23'; and the valve assembly 56 in the open position, a reverse circulation of the circulating fluid can be used to apply an upward force on inner surfaces of the fins 112 as shown by arrows 114. These upward forces can be used to shear the shear pins 104 of the memory module 23', allowing the reverse circulation of the circulating fluid to carry the plug 108 and the memory module 23' to the surface 14 of the wellbore 16.

In still another alternative, a wet connect assembly (also called a data transfer plug) may be pumped down and connected to the deployment head 22 such that logging data stored in the memory module 23 can be transferred from the memory module 23 to the wet connect; and from the wet connect to the surface 14 of the wellbore 16. Using this method, the logging data can be retrieved to the surface without withdrawing any of the components of the deployment head 22 or the memory logging tool 24 from the wellbore 16.

In another embodiment according to the present invention, the pipe conveyed well logging assembly 10 may be used to perform a first logging operation to obtain logging data related to a desired portion of the wellbore 16; and then the assembly 10 may be used to perform a second logging operation to obtain logging data related the same portion of the wellbore 16 as that of the first logging operation. This second logging operation can be referred to as a confirmation logging operation. In one embodiment, both the first logging operation and the confirmation logging operation are performed before the logging data is retrieved to the surface 14 of the wellbore 16.

In the above description, although element 24 is described as being a memory logging tool, the entire assembly which includes element 24 can be called a memory logging tool. For example, the entire assembly of FIG. 2 can be considered to be a memory logging tool. Using this nomenclature, what is described above as the deployment head 22 with respect to FIG. 2 can be described as an upper portion (or deployment portion) of the memory logging tool; and what is described above as the memory logging tool 24 with respect to FIG. 2 can be described as a lower portion (or logging portion) of the memory logging tool.

The preceding description has been presented with references to certain exemplary embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings. Instead, the scope of the application is to be defined by the appended claims, and equivalents thereof.

What is claimed is:

1. A method of performing a pipe conveyed well logging operation comprising:

providing a pipe conveyed well logging assembly comprising a pipe string, a memory logging tool and a memory module;

deploying the assembly into a wellbore;

operating the memory logging tool to perform a logging operation to obtain logging data from the wellbore; and retrieving the obtained logging data prior to withdrawing the pipe string from the wellbore.

2. The method of claim 1, further comprising storing the obtained logging data in the memory module; and removably connecting the memory module to the memory logging tool.

3. The method of claim 2, wherein said retrieving comprises:

removing the memory module from the memory logging tool; and withdrawing the memory module from the wellbore.

4. The method of claim 3, wherein said withdrawing of the memory module comprises attaching a fishing tool to the memory module.

5. The method of claim 4, wherein said fishing tool is connected to a slickline cable.

6. The method of claim 3, wherein said withdrawing of the memory module comprises attaching a pumpable plug to the memory module.

7. The method of claim 6, wherein said withdrawing of the memory module comprises reverse circulating a fluid through the assembly.

8. The method of claim 2, wherein said retrieving comprises:

removing the memory module from the memory logging tool; and withdrawing the memory module from the wellbore prior to withdrawing the memory logging tool from the wellbore.

9. The method of claim 2, wherein said retrieving comprises:

removing the memory module from the memory logging tool; and withdrawing the memory module from the wellbore in a separate operation from a withdrawing of the memory logging tool from the wellbore.

10. The method of claim 1, further comprising storing the obtained logging data in the memory module, and wherein said retrieving comprises:

attaching a data transfer plug to the assembly;

transferring the stored data from the memory module to the data transfer plug; and conveying the stored data from the data transfer plug to a surface of the wellbore.

11. The method of claim 1, further comprising operating the memory logging tool to perform a second logging operation to obtain a second set of logging data from the wellbore, wherein said logging operation and said second logging operation are each performed prior to said retrieving.

12. The method of claim 1, further comprising operating the memory logging tool to perform a second logging operation to obtain a second set of logging data from the wellbore, wherein said logging operation and said second logging operation are each performed prior to a withdrawing of the memory logging tool from the wellbore.

13. The method of claim 1, wherein said retrieving comprises withdrawing the memory logging tool from the wellbore.

14. The method of claim 13, wherein said withdrawing of the memory logging tool comprises attaching a fishing tool to the memory logging tool.

15. The method of claim 1, wherein said retrieving further comprises:

providing a slickline deployable tool;

connecting the slickline deployable tool to the memory logging tool; and withdrawing the memory logging tool from the wellbore.

16. The method of claim 2, wherein said retrieving further comprises:

providing a slickline deployable tool;

connecting the slickline deployable tool to the memory module; and withdrawing the memory module from the wellbore.

17. A method of performing a pipe conveyed well logging operation comprising:

providing a pipe conveyed well logging assembly comprising a pipe string, a memory logging tool and a memory module;

removably connecting the memory module to the memory logging tool;

deploying the assembly into a wellbore;

operating the memory logging tool to perform a logging operation to obtain logging data from the wellbore;

storing the obtained logging data in the memory module; and retrieving the stored logging data prior to withdrawing the memory logging tool from the wellbore.

18. The method of claim 17, wherein said retrieving comprises removing the memory module from the memory logging tool and withdrawing the memory module from the wellbore.

19. The method of claim 18, wherein said withdrawing of the memory module comprises attaching a slickline deployed fishing tool to the memory module.

20. The method of claim 18, wherein said withdrawing of the memory module comprises:

attaching a pumpable plug to the memory module; and reverse circulating a fluid through the assembly.

21. The method of claim 17, wherein said retrieving comprises:

attaching a data transfer plug to the assembly;

transferring the stored data from the memory module to the data transfer plug; and conveying the stored data from the data transfer plug to a surface of the wellbore.

22. The method of claim 17, further comprising operating the memory logging tool to perform a second logging operation to obtain a second set of logging data from the wellbore, wherein said logging operation and said second logging operation are each performed prior to said retrieving.

23. The method of claim 17, wherein said retrieving further comprises:

providing a slickline deployable tool;

connecting the slickline deployable tool to the memory module; and withdrawing the memory module from the wellbore.

* * * * *